United States Patent [19]

Avila

[11] Patent Number: 4,600,102

[45] Date of Patent: Jul. 15, 1986

[54] MINIATURE FANCIFUL SIMULATED OIL BARREL CONTAINING CRUDE OIL AND INDICIA MEANS THEREON USEFUL AS A NOVELTY ITEM

[76] Inventor: Ali R. Avila, Avenida Alfredo Jahn, Residencias Parque Jahn, Sixth Floor, No. 6-C, ZP 1062 P.O. Box 3121, Palos Grandes, Venezuela

[21] Appl. No.: 611,722

[22] Filed: May 18, 1984

[51] Int. Cl.[4] ..... B65D 85/82

[52] U.S. Cl. ..... 206/457; 200/459; 40/306

[58] Field of Search ..... 206/457, 459; D34/39; D9/325, 307; 40/356

[56] References Cited

U.S. PATENT DOCUMENTS

| | | | |
|---|---|---|---|
| D. 9,860 | 3/1877 | Bodine | D9/325 |
| D. 16,085 | 5/1885 | Adams | D9/325 |
| D. 123,637 | 11/1940 | Karoff | D9/325 |
| D. 209,631 | 12/1967 | Schaper et al. | D34/39 |
| D. 228,489 | 10/1973 | Mascia | D9/325 |
| D. 238,554 | 1/1976 | Edwards | D9/325 |
| D. 241,717 | 10/1976 | Chase et al. | D34/39 |
| D. 254,293 | 2/1980 | Fortuna et al. | D9/325 |
| 540,697 | 6/1895 | Shulin | 223/108 |
| 2,186,940 | 1/1940 | Sullivan | 40/356 |
| 2,484,776 | 10/1949 | Zent et al. | 206/457 |

*Primary Examiner*—William T. Dixson, Jr.
*Assistant Examiner*—Brenda J. Ehrhardt
*Attorney, Agent, or Firm*—Alfred Musumeci

[57] ABSTRACT

A novelty item which is particularly useful as a decorative piece is formed as a miniaturized transparent container shaped to authentically simulate a barrel normally used to contain crude oil with a quantity of authentic crude oil being contained within the container and visible therein, the container being sealed to prevent removal of the oil and having a label or other markings on the outside thereof consisting of a name or designation fancifully associated with crude oil or the ownership or production thereof.

4 Claims, 1 Drawing Figure

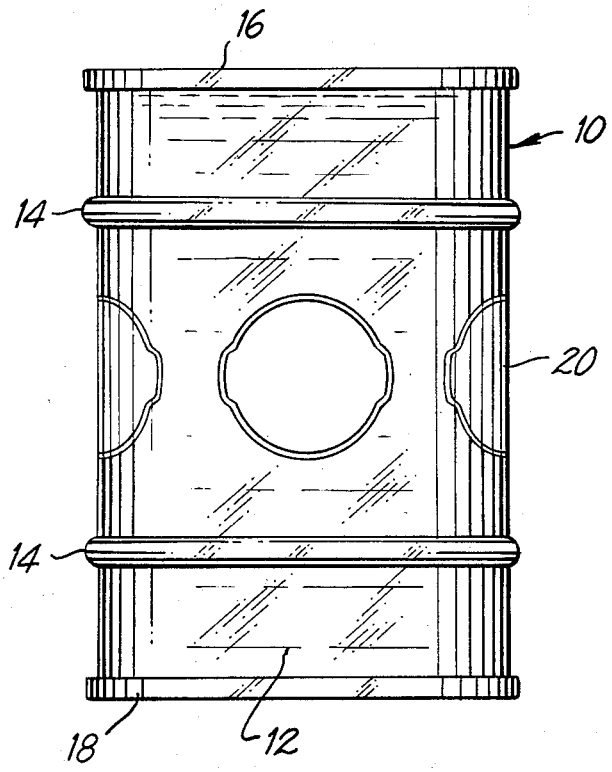
16
10
14
20
14
18
12

MINIATURE FANCIFUL SIMULATED OIL BARREL CONTAINING CRUDE OIL AND INDICIA MEANS THEREON USEFUL AS A NOVELTY ITEM

The present invention relates to a novelty item or decorative device and more particularly to the imaginative concept and structural configuration of a relatively small amusement article.

Creation of a new novelty item involves several necessary but somewhat diverse accomplishments. A primary factor determining the value and contribution of an inventive new novelty device relates to whether there has been created an item which will meet with commercial acceptance and success. One important aspect of such success depends upon the esthetic quality of the item. This quality must be such that the item will be found desirable and attractive to a prospective purchaser and user thereof. Such attractiveness is created when the appearance and general effect produced by the novelty item is cleverly and imaginatively conceived and originated entailing a certain indefinable quality that stimulates attention and the interest of the purchaser. This quality is necessarily of a fanciful and intangible nature, but requires both a commercial as well as an esthetic achievement.

A further aspect of this area of endeavor, which increases the degree of skill and creativeness which must be imparted in the development of a new novelty device, is the fact that the device must be relatively inexpensive to fabricate and it must be constructed in a manner which will not only enhance and effectuate the fanciful objectives of the novelty item but its construction must also be relatively simple, economical and inexpensive to manufacture. Again, commercial success of a novelty item will be dependent upon the sale price thereof and it will be found that certain novelty items must of commercial necessity be maintained within rigid price levels. Accordingly, the embodiment of a fanciful concept involving a novelty item must be of such a structural nature that it not only provides an effective physical manifestation of the fanciful concepts involved but it must also do so in a manner which features simplicity and ease of construction and assembly and economy of manufacturing while at the same time promoting the commercial success thereof.

Accordingly, the present invention is directed toward providing a novelty item which is esthetically, fancifully and attractively created and which involves a structural manifestation of a fanciful concept adapted to create interest and amusement while capitalizing upon a contemporary event and phenomenon.

SUMMARY OF THE INVENTION

Briefly, the present invention may be described as a novelty item particularly useful as a decorative or conversation piece comprising a miniature transparent container shaped to simulate an authentic barrel normally used to contain oil, a quantity of authentic crude oil contained in said container and visible therein, said container being sealed to prevent removal of said crude oil therefrom and indicia means on the outside of said container adapted to have imprinted thereon a name or designation fancifully associated with crude oil.

DESCRIPTION OF THE DRAWING

The single FIGURE of drawing is a perspective view showing a novelty item in accordance with the present invention.

DETAILED DESCRIPTION OF THE PREFERRED EMBODIMENT

Referring now to the drawing, there is shown a container 10 which is shaped in the form of an authentic oil barrel or a barrel normally used to contain oil.

The container 10 shown in the drawing is made of transparent material and has contained therein a quantity of crude oil 12 sufficient to completely fill the interior of the container 10.

It will be appreciated that the container 10 being made of transparent material enables the crude oil to be visible.

Furthermore, it will be seen that the container 10 is quite small in size and is merely a miniaturized simulation of a real oil barrel.

A container structured in accordance with the present invention may be, for example, on the order of 6 inches high and approximately 4 inches in diameter, these dimensions of course being approximate and merely for the purpose of exemplifying the basic dimensions of the item. It should be understood that the item is intended as a miniaturized item capable of being held in the hand and placed on a flat surface for decoration or general novelty interest.

The container 10 is formed with a pair of ridges 14 which are located to extend completely around the perimeter of the container. The ridges are intended to simulate similar ridges found on larger actual barrels normally containing crude oil.

The container 10 is also provided with covers 16 and 18 at the top and bottom thereof. The lower cover 18 may be formed of a material similar to the material of the container which may, of course, be glass.

The upper cover 16 may be formed separately from the container but after the container has been filled with the crude oil 12 the upper cover 16 is applied in a sealed and nonremovable manner in order to maintain the oil in airtight condition within the container so as to be spillproof.

Of particular importance is indicia means 20 which are provided on the outside of the container about the midpoint thereof.

It will be noted that during the present time activities related to the production and sale of oil are prominently discussed in the news media.

Furthermore, there are several entertainment programs related to the concept of wealthy oil families.

Thus, oil has become a much-discussed item and the concept of oil and its ownership and production tends generally to attract attention.

The present invention seeks to capitalize on the attention received by oil and the indicia means 20 shown on the container 10 are intended to have imprinted thereon a name or other designation of a fanciful nature indicating possibly the ownership of the crude oil or the production of the crude oil.

For example, in a recent well-known television program, a particular family is quite prominent because of the wealth they have achieved relating to their ownership of oil properties. Application of such a name or of the name of any one of several very well-known oil companies could be applied to the indicia means 20 in order to further enhance the novelty and interest of the container 10.

It will therefore be seen that the present invention provides a novelty item which can generate substantial interest and one which is considered capable of achieving significant commercial success. The oil 12 which is contained within the container is real authentic crude oil and therefore the concept of purchasing the container with the crude oil therein would be enhanced by the idea of a purchaser "owning" a specified amount of a certain type of oil.

Of course, it will be understood that any one of a number of names could be utilized on the indicia means 20 and the name which is utilized should be one which will enhance the fancifulness of the device and create further interest therein.

While a specific embodiment of the invention has been shown and described in detail to illustrate the application of the inventive principles, it will be understood that the invention may be embodied otherwise without departing from such principles.

What is claimed is:

1. A novelty item particularly useful as a decorative or conversation piece comprising a miniature container consisting essentially of a transparent material shaped to simulate an authentic barrel normally used to contain oil, a quantity of authentic crude oil contained inside said container and visible therein, said container being sealed to prevent removal of said crude oil therefrom and indicia means on the outside of said container having imprinted thereon a name or designation fancifully associated with crude oil.

2. An item according to claim 1 wherein said container is made of glass.

3. A novelty item particularly useful as a decorative or conversation piece comprising a miniature container consisting essentially of a transparent material shaped to simulate an authentic barrel normally used to contain crude oil, said container being constructed as a right circular cylinder having a top and a bottom integrally structured as a hollow sealed object, with the diameter of said cylinder being approximately sixty percent of the height thereof, and with a pair of circular ridges being formed to extend completely around the circumference of said cylinder, one of said ridges being spaced from said top by a distance approximately one-third the height of said cylinder and the other of said ridges being spaced from said bottom by a distance approximately one-third the height of said cylinder, said ridges defining therebetween an annular panel approximately midway between said top and said bottom, a quantity of authentic crude oil contained inside said container and visible therein, said container being completely sealed to prevent removal of said crude oil therefrom and indicia means on said annular panel having imprinted thereon the name of an oil company, real or fanciful.

4. An item according to claim 3, wherein said container is made of injection-molded plastic.

* * * * *